US009604090B1

(12) United States Patent
Meyer et al.

(10) Patent No.: US 9,604,090 B1
(45) Date of Patent: Mar. 28, 2017

(54) WEIGHT STACK ASSEMBLIES FOR EXERCISE APPARATUSES

(71) Applicant: Brunswick Corporation, Lake Forest, IL (US)

(72) Inventors: Mathew R. Meyer, Hanover, MI (US); Lee M. Atwood, St. Francis, MN (US)

(73) Assignee: Brunswick Corporation, Lake Forest, IL (US)

( * ) Notice: Subject to any disclaimer, the term of this patent is extended or adjusted under 35 U.S.C. 154(b) by 212 days.

(21) Appl. No.: 14/487,486

(22) Filed: Sep. 16, 2014

(51) Int. Cl.
*A63B 21/00* (2006.01)
*A63B 21/062* (2006.01)

(52) U.S. Cl.
CPC .... *A63B 21/062* (2013.01); *A63B 2021/0623* (2013.01)

(58) Field of Classification Search
CPC ..... A63B 21/00
USPC ..... 482/88, 89, 102
See application file for complete search history.

(56) References Cited

U.S. PATENT DOCUMENTS

| | | | | |
|---|---|---|---|---|
| 5,056,779 | A | 10/1991 | Webb | |
| 5,104,121 | A | 4/1992 | Webb | |
| 5,776,040 | A | 7/1998 | Webb et al. | |
| 5,876,313 | A | 3/1999 | Krull | |
| 6,719,672 | B1 | 4/2004 | Ellis et al. | |
| 6,902,516 | B2 | 6/2005 | Krull | |
| 7,413,532 | B1 | 8/2008 | Monsrud et al. | |
| 2003/0092542 | A1* | 5/2003 | Bartholomew | A63B 21/0628 482/99 |
| 2005/0176559 | A1 | 8/2005 | Carter | |
| 2006/0205571 | A1 | 9/2006 | Krull | |
| 2006/0217245 | A1* | 9/2006 | Golesh | A63B 21/0628 482/94 |
| 2007/0149366 | A1* | 6/2007 | Kuo | A63B 21/0628 482/98 |

* cited by examiner

*Primary Examiner* — Jerome W Donnelly
(74) *Attorney, Agent, or Firm* — Andrus Intellectual Property Law, LLP

(57) ABSTRACT

A weight stack assembly is for an exercise apparatus. The weight stack assembly comprises a plurality of primary weights and a plurality of secondary weights that are located next to the plurality of primary weights. A head plate is on the plurality of primary weights. A primary weight selector mechanism is on the head plate and is configured to couple a user force receiving member to one or more of the plurality of primary weights. A secondary weight selector mechanism is on the head plate and is configured to couple the head plate to a first secondary weight in the plurality of secondary weights, and to couple the head plate to a second secondary weight in the plurality of secondary weights. The secondary weight selector mechanism is configured to engage with the first secondary weight so that the first secondary weight remains balanced in the horizontal direction when a force is applied to the user force receiving member. The secondary weight selector mechanism is further configured to engage with the second secondary weight so that the first and second secondary weights remain balanced in the horizontal direction when the force is applied to user force receiving member.

20 Claims, 8 Drawing Sheets

WEIGHT STACK ASSEMBLIES FOR EXERCISE APPARATUSES

FIELD

The present disclosure relates to exercise apparatuses and more particularly to weight stack assemblies for exercise apparatuses.

BACKGROUND

U.S. Pat. No. 7,413,532, which is incorporated herein by reference, discloses an exercise apparatus having a weight stack for opposing a given exercise motion. The weight stack has a first set of a plurality of primary weights vertically stacked on each other, a primary weight selector having a plurality of settings selectively controlling the number of weights to be lifted during the exercise motion, a second set of a plurality of secondary weights, and a secondary weight selector having a plurality of settings selectively controlling the number of secondary weights to be lifted during the exercise motion, the secondary weights providing supplemental incremental weight.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

A weight stack assembly is for an exercise apparatus. The weight stack assembly comprises a plurality of primary weights that are stacked in a vertical direction. Each primary weight in the plurality of primary weights extends in the vertical direction, in a horizontal direction that is perpendicular to the vertical direction, and in a lateral direction that is perpendicular to the vertical direction and perpendicular to the horizontal direction. A plurality of secondary weights are stacked in the vertical direction and are located next to the plurality of primary weights in the lateral direction. Each secondary weight in the plurality of secondary weights extends in the vertical direction, horizontal direction, and lateral direction. Each secondary weight weighs less than each primary weight. A head plate is displaced on top of the plurality of primary weights in the vertical direction. A primary weight selector mechanism is on the head plate. The primary weight selector mechanism is configured to couple a user force receiving member to one or more of the plurality of primary weights. A secondary weight selector mechanism is on the head plate. The secondary weight selector mechanism is configured to couple the head plate to a first secondary weight in the plurality of secondary weights and to couple the head plate to a second secondary weight in the plurality of secondary weights. The secondary weight selector mechanism is configured to engage with the first secondary weight so that the first secondary weight remains balanced in the horizontal direction when a force is applied to the user force receiving member. The secondary weight selector mechanism is further configured to engage with the second secondary weight so that the first and second secondary weights remain balanced in the horizontal direction when the force is applied to user force receiving member.

BRIEF DESCRIPTION OF THE DRAWINGS

Examples of weight stack assemblies for exercise apparatuses are described with reference to the following drawing figures. The same numbers are used throughout the figures to reference like features and components.

DETAILED DESCRIPTION OF THE DRAWINGS

Figure 1:
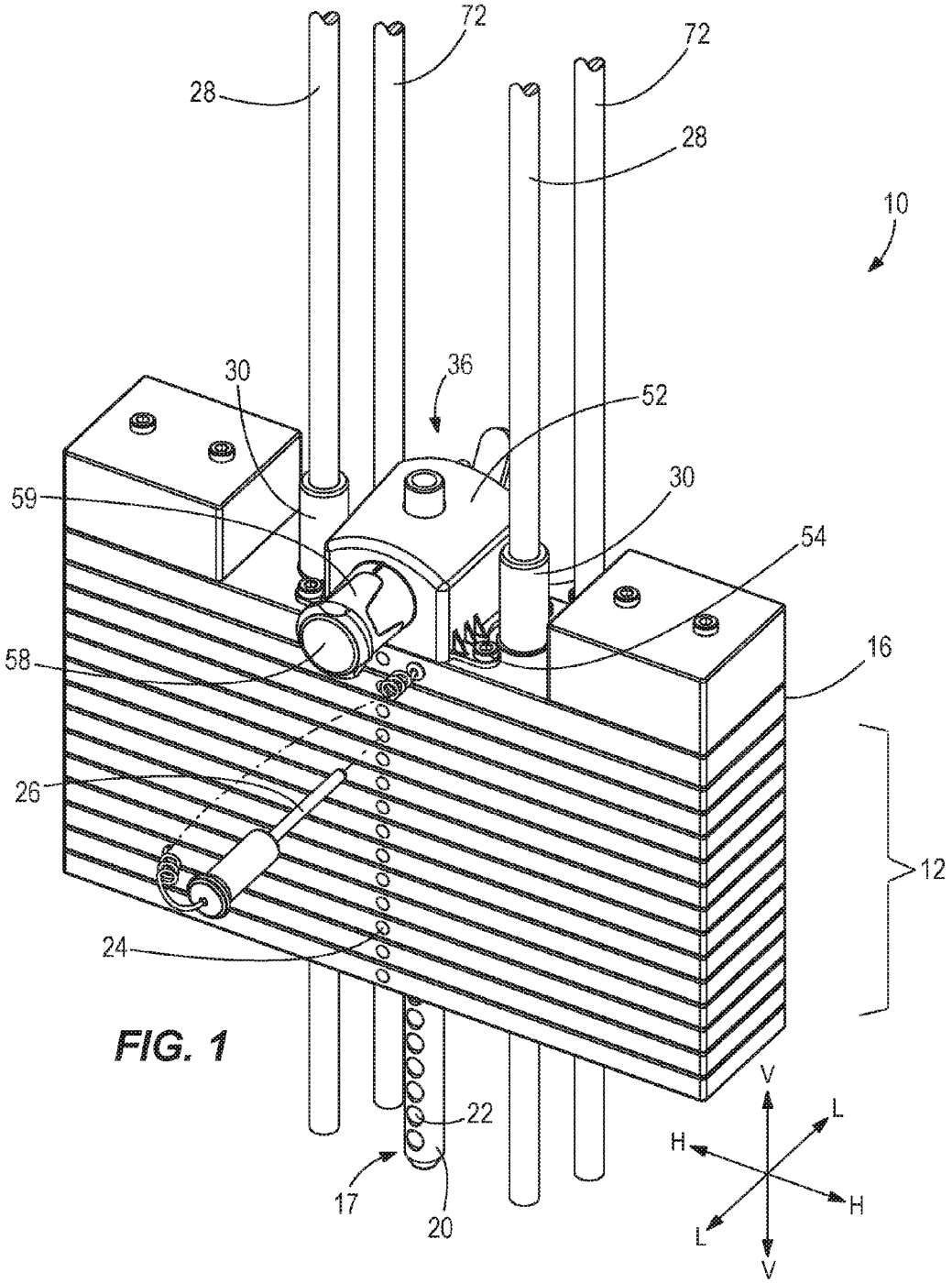
FIG. 1 is a front perspective view of a weight stack assembly for an exercise apparatus.
Figure 2:
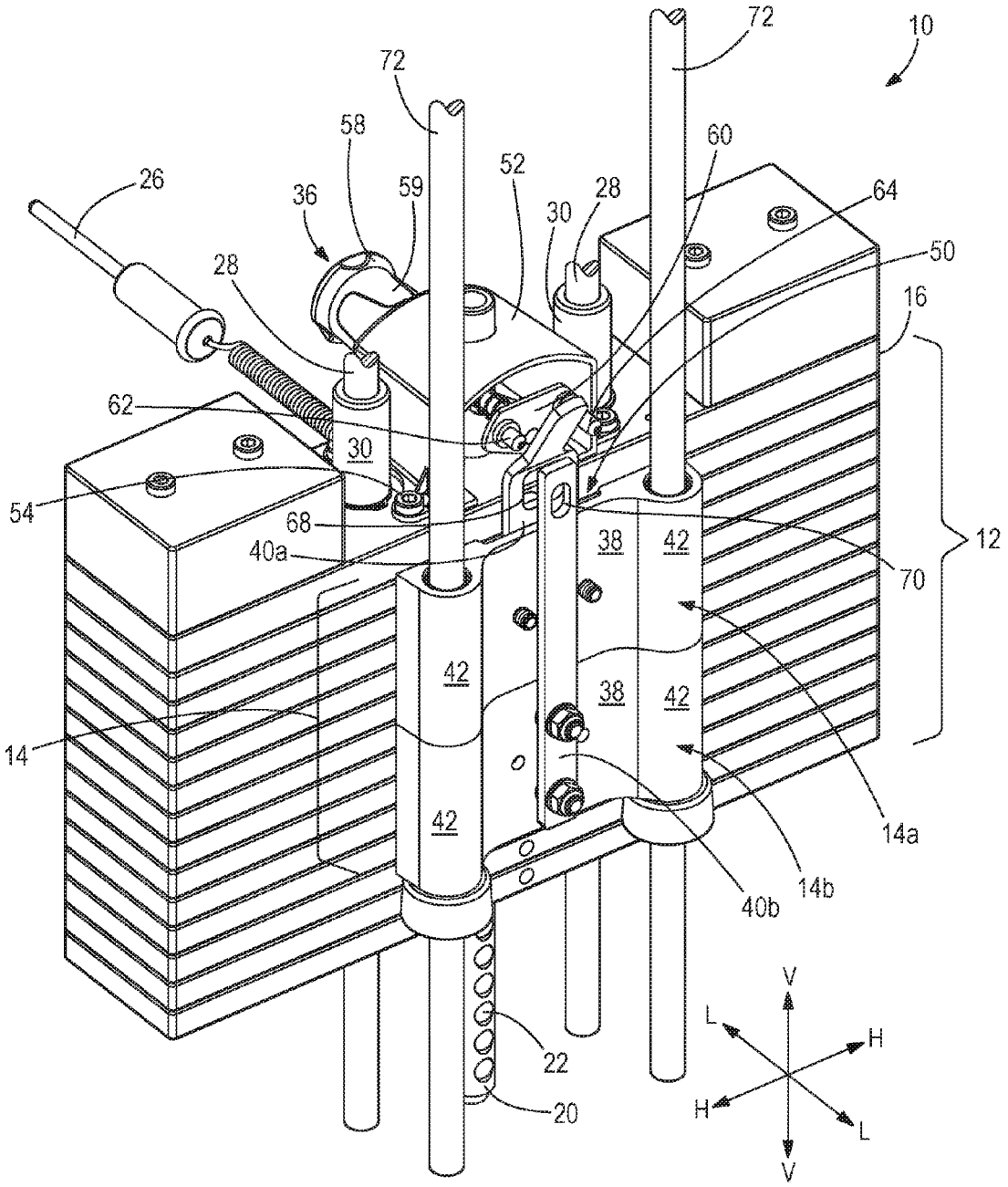
FIG. 2 is a rear perspective view of the weight stack assembly.
Figure 3:
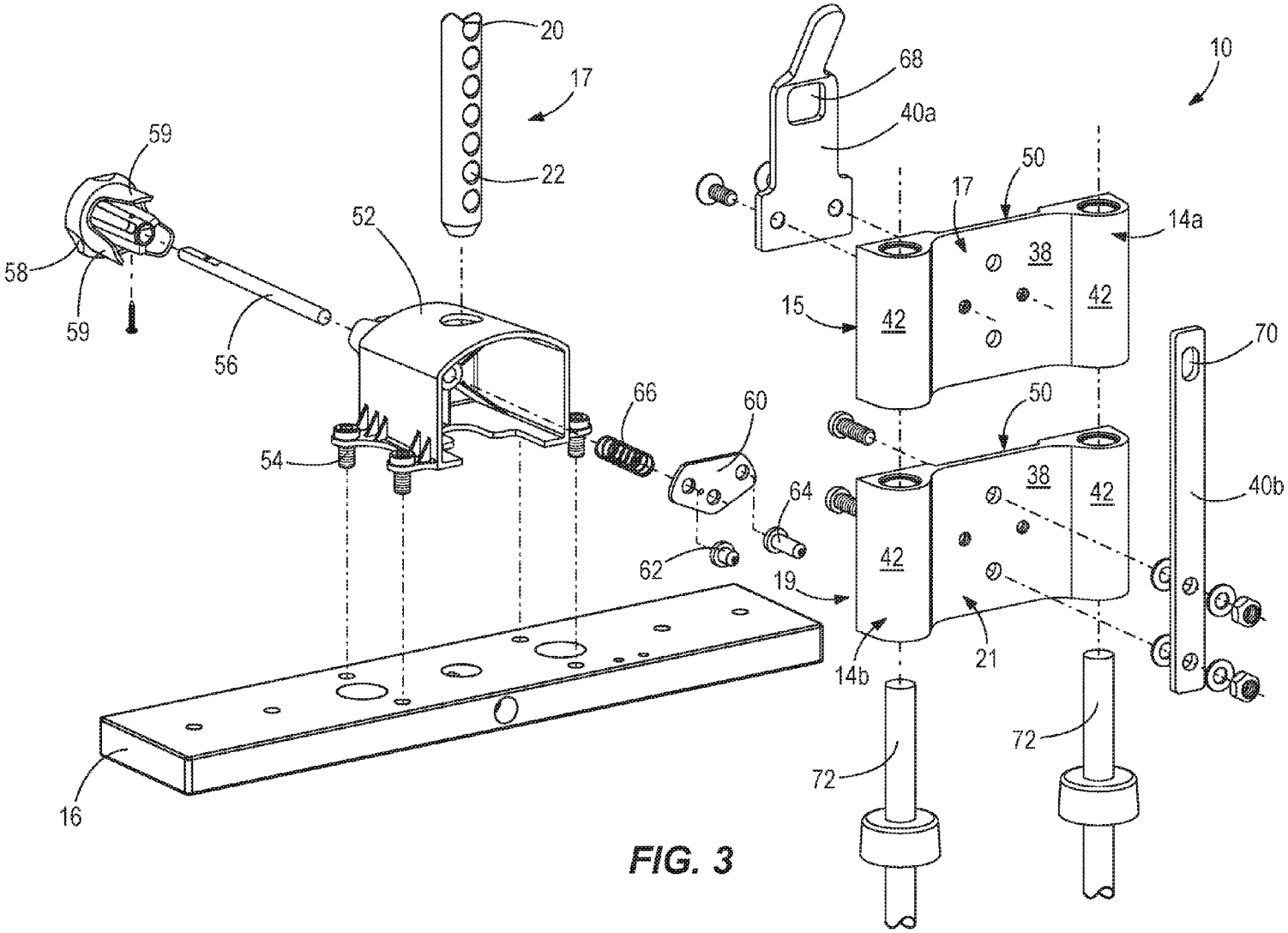
FIG. 3 is an exploded view of the weight stack assembly.

FIGS. 1-3 depict a weight stack assembly 10 for an exercise apparatus. The weight stack assembly 10 includes a plurality of primary weights 12 that are stacked in a vertical direction V. Each primary weight 12 extends in the vertical direction V, in a horizontal direction H that is perpendicular to the vertical direction V, and in a lateral direction L that is perpendicular to the vertical direction V and perpendicular to the horizontal direction H. A plurality of secondary weights 14 are stacked in the vertical direction V and are located next to the plurality of primary weights 12 in the lateral direction L. Each secondary weight 14 extends in the vertical direction V, horizontal direction H and the lateral direction L. The plurality of primary weights 12 are longer in the horizontal direction H than the lateral direction L. The plurality of secondary weights 14 are longer in the horizontal direction H than the lateral direction L. In this example, the plurality of primary weights 12 are rectangular. The plurality of secondary weights 14 have a rectangular cross-section taken in the vertical and horizontal directions V, H. The secondary weights 14 weigh less than the primary weights 12.

Figure 7:
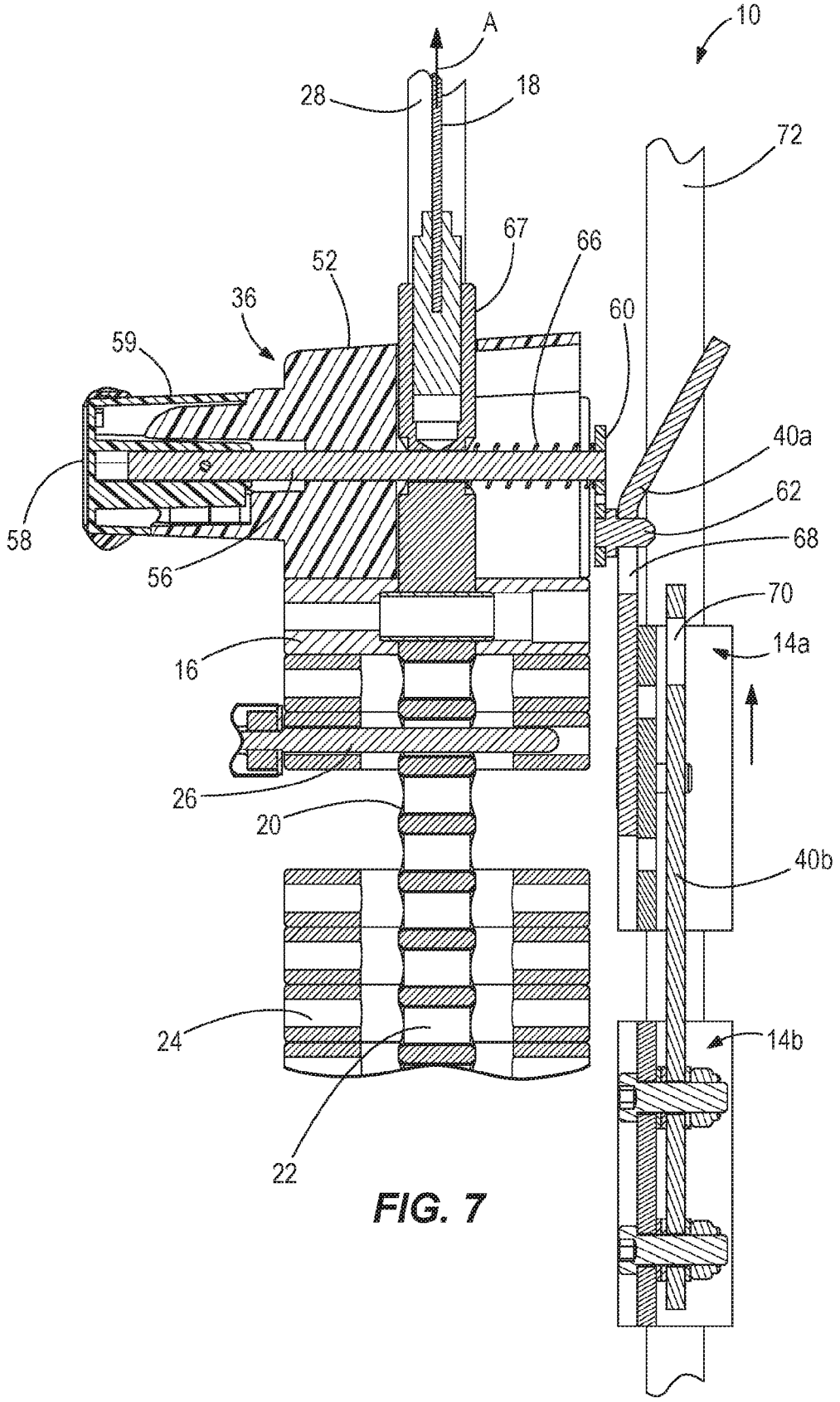
FIG. 7 is a view of section 7-7, taken in FIG. 6.

A head plate 16 is disposed on top of the plurality of primary weights 12. A primary weight selector mechanism 17 is attached to the head plate 16 and is configured to couple a user force receiving member 18 (FIGS. 4-9) to one or more of the plurality of primary weights 12. In this example, the user force receiving member 18 includes a cable (FIGS. 4-9); however the type of user force receiving member 18 can vary and can include a handle, bar, lever, and/or the like. The type of primary weight selector mechanism can also vary. In this example, the primary weight selector mechanism 17 includes a bayonet 20 that is connected to the user force receiving member 18 via the head plate 16 and vertically extends through center holes in the plurality of primary weights 12. As shown in FIGS. 7 and 9, the bayonet 20 includes a plurality of apertures 22 that are vertically and laterally aligned with laterally extending apertures 24 in the plurality of primary weights 12 when the user force receiving member 18 is at rest.

In use, a selector pin 26 is manually inserted into one of the laterally extending apertures 24 of one of the plurality of primary weights 12 (see FIGS. 7 and 9) and further into the aligned aperture 22 in the bayonet 20. This couples the noted primary weight 12 and all primary weights 12 stacked on top of the noted primary weight 12 to the head plate 16 and user force receiving member 18. Thereafter, a user-applied force on the user force receiving member 18 in the direction of arrow A (FIG. 7) lifts the head plate 16 and the primary weights 12 that are coupled to the head plate 16 by the bayonet 20 via the selector pin 26. The head plate 16 and the primary weights 12 are configured to vertically move along a pair of primary guide rods 28, which extend through the head plate 16 and the plurality of primary weights 12, as shown in FIGS. 7 and 9. A pair of bushings 30 are provided on the head plate 16 and are configured to slide along the primary guide rods 28, independently of the plurality of secondary weights 14.

A secondary weight selector mechanism 36 is disposed on the head plate 16. As described further herein below, the secondary weight selector mechanism 36 is configured to move (in this example rotate and laterally translate) from at least a first position (shown in FIG. 6) wherein the secondary weight selector mechanism 36 couples the head plate 16 to one of the secondary weights 14*a* to a second position (shown in FIG. 8) wherein the secondary weight selector mechanism 36 couples the head plate 16 to a different one of the secondary weights 14*b*. Optionally, the secondary weight selector mechanism 36 can be configured to move to a third position (shown in FIG. 2) wherein the secondary weight selector mechanism 36 does not couple the head plate 16 to either of the secondary weights 14*a*, 14*b*. The exact configuration of the secondary weight selector mechanism 36 can vary and the following text describes one particular example of such configuration and the interaction between the secondary weight selector mechanism 36 and secondary weights 14.

In this example, the plurality of secondary weights 14 includes a first secondary weight 14*a* and a second secondary weight 14*b*. However, the number of secondary weights can vary from that which is shown. The first secondary weight 14*a* is vertically stacked on top of the second secondary weight 14*b*. Each secondary weight 14*a*, 14*b* includes a body 38 and a pick-up bracket 40*a*, 40*b* that vertically extends from the body 38. Each pick-up bracket 40*a*, 40*b* is centered on each respective secondary weight 14*a*, 14*b* in the horizontal direction H. Each of the secondary weights 14*a*, 14*b* includes a set of bushings 42 that are spaced apart in the horizontal direction H and vertical direction V and are configured to slide along secondary guide rods 44 in the vertical direction V, independently of the head plate 16.

Referring to FIG. 3, the first secondary weight 14*a* has an inner surface 15 and an opposite outer surface 17. The inner surface 15 faces the plurality of primary weights 12, whereas the outer surface 17 faces away from the plurality of primary weights 12. The second secondary weight 14*b* also has an inner surface 19 and an outer surface 21. The inner surface 19 faces the plurality of primary weights 12 whereas the outer surface 21 faces away from the plurality of primary weights 12. The pick-up bracket 40*a* of the first secondary weight 14*a* is attached to the inner surface 15 of the first secondary weight 14*a*. The pick-up bracket 40*b* of the second secondary weight 14*b* is attached to the outer surface 21 of the second secondary weight 14*b*. The inner surface 15 of the first secondary weight 14*a* defines a cavity 50 in which the pick-up bracket 40*a* is mounted. The inner surface 19 of the second secondary weight 14*b* also has the cavity 50.

Referring to FIGS. 4-9, the secondary weight selector mechanism 36 includes a housing 52 that is attached to the head plate 16 by a plurality of bolts 54. An axle 56 laterally extends through and is supported for rotation with respect to the housing 52. A handle 58 is disposed on one end of the axle 56 and an end plate 60 is disposed on an opposite end of the axle 56 and has conventional detents that engage with the housing 52, as taught in the incorporated U.S. Pat. No. 7,413,532. First and second engagement pins 62, 64 extend from the end plate 60 in the lateral direction L. Each of the first and second engagement pins 62, 64 is configured to engage with only one of the pick-up brackets 40*a*, 40*b* in the plurality of secondary weights 14, as will be described herein below. Together, the axle 56, handle 58 and end plate 60 comprise a rotary member that is configured to sequentially move the first and second engagement pins 62, 64 into a horizontal position in which the first and second engagement pins 62, 64 can engage with the pick-up brackets 40*a*, 40*b* of the first and second secondary weights 14*a*, 14*b* respectively. The rotary member is biased towards the plurality of secondary weights 14 in the lateral direction L. In this example, a spring 66 provides the noted bias. The spring 66 is disposed on the axle 56 and biases the end plate 60 away from the housing 52. In this manner, the handle 58 is configured to be pulled by a user against the bias of the spring 66 (in the direction of arrow B) to withdraw the first and second engagement pins 62, 64 from the pickup brackets 40*a*, 40*b* and thus disengage the secondary weight selector mechanism 36 from the plurality of secondary weights 14, and the handle 58 is configured to be rotated (as shown by arrows C) to engage the first and second engagement pins 62, 64 with different ones of the plurality of secondary weights 14, as will be described further herein below. The handle 58 has detents 59 that secure the handle 58 in the noted first, second and third positions when the handle 58 is moved in the direction of the arrow D by the spring 66.

In this example the pick-up brackets 40*a*, 40*b* are horizontally centered on the secondary weights 14 and have apertures 68, 70 that are aligned with each other in the lateral direction L so as to define a centered, lateral through path P for the first and second engagement pins 62, 64. The first engagement pin 62 is shorter than the second engagement pin 64 in the lateral direction L. The first engagement pin 62 is configured to engage with the pick-up bracket 40*a* of the first secondary weight 14*a* and the second engagement pin 64 is configured to engage with the pick-up bracket 40*b* of the second secondary weight 14*b*. As will be explained further herein below, engagement of the first engagement pin 62 with the pick-up bracket 40*a* of the first secondary weight 14*a* couples the first secondary weight 14*a* and not the second secondary weight 14*b* to the head plate. Engagement of the second engagement pin 64 to the pick-up bracket 40*b* of the second secondary weight 14*b* couples both of the first and second secondary weights 14*a*, 14*b* to the head plate. The pick-up brackets 40*a*, 40*b* of the first and second secondary weights 14*a*, 14*b* are configured such that the second engagement pin 64 extends through and does not engage with the pick-up bracket 40*a* of the first secondary weight 14*a* when the second engagement pin 64 engages with the pick-up bracket 40*b* of the second secondary weight 14*b*. In this example, the aperture 68 of the pick-up bracket 40*a* of the first secondary weight 14*a* has an upper engagement surface 76 that is located vertically higher than the aperture 70 of the pick-up bracket 40*b* so that the second engagement pin 64 does not engage with the pick-up bracket 40*a* when the second engagement pin 64 lifts the pick-up bracket 40*b* of the second secondary weight 14*b*. This facilitates a smoother interaction and lifting action on the user force receiving member 18. The first secondary weight 14*a* is engaged by the top surface 78 of the second secondary weight 14*b* instead of delayed engagement between the second engagement pin 64 and the aperture 68 of the pick-up bracket 40*a*.

Figure 4:
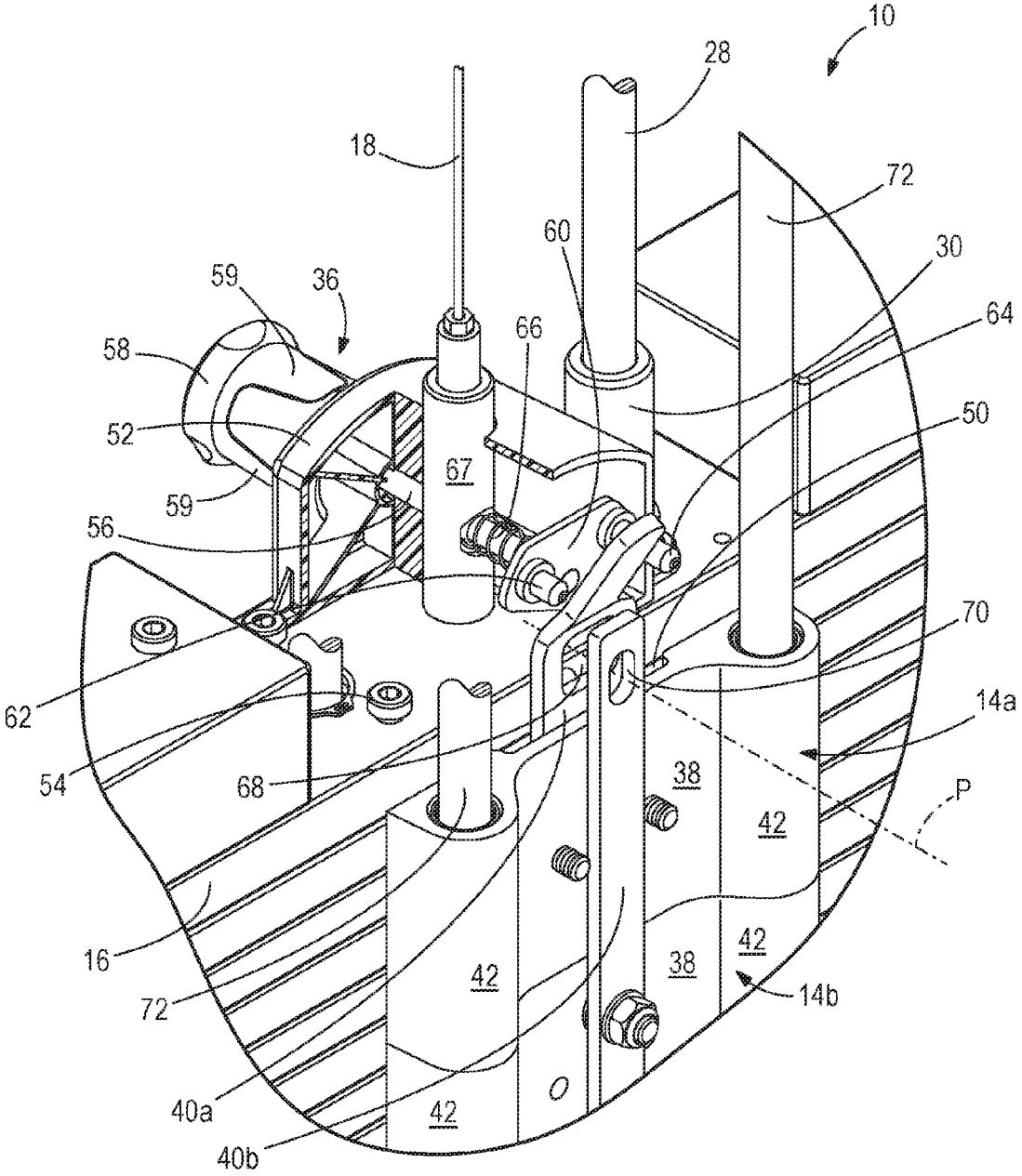
FIG. 4 is a view of a portion of the weight stack assembly, including a secondary weight selector mechanism.
Figure 5:
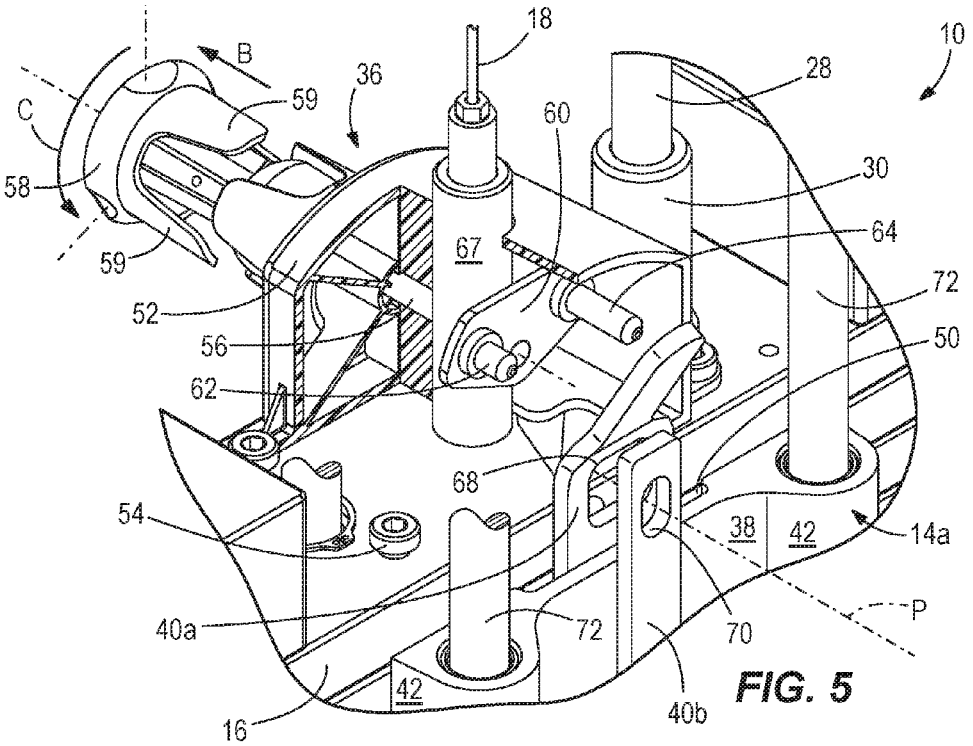
FIG. 5 is a view of the secondary weight selector mechanism, partially broken away.
Figure 6:
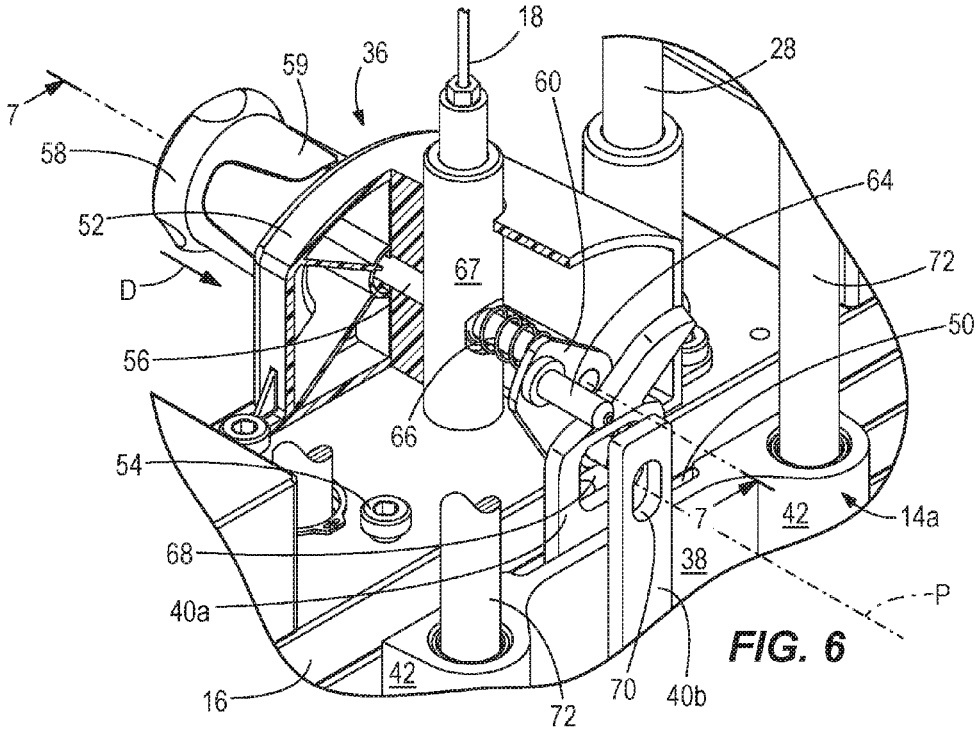
FIG. 6 is another view of the secondary weight selector mechanism, partially broken away.

In use, once the user selects a number of primary weights 12 via the selector pin 26, the user has the option to also select a number of secondary weights 14 via the secondary weight selector mechanism 36. As shown in FIGS. 4 and 5, the user can pull on the handle 58 in the direction of arrow B then and rotate the handle 58, as shown at the arrow C, to thereby rotate the axle 56 and the end plate 60, so as to align one of the first and second engagement pins 62, 64 with the apertures 68, 70 and lateral through bore P. When the user releases the handle 58, the spring 66 pushes on the center tube 67 of the bayonet 20 and the end plate 60, which forces one of the first and second engagement pins 62, 64 into one or more of the apertures 68, 70 (as shown in FIGS. 7 and 9, respectively) or none of the apertures 68, 70 (as shown in FIG. 2. In a first position shown in FIG. 6, the first engagement pin 62 is aligned with the aperture 68 of the pick-up bracket 40*a* of the first secondary weight 14*a*. As shown in FIG. 7, when a user-applied force is applied to the user force receiving member 18, the bayonet 20 is lifted in the vertical direction and with it carries a certain number of primary weights 12, as determined by the location of the selector pin 26. In addition, via engagement between the first engagement pin 62 and the pick-up bracket 40*a*, the first secondary weight 14*a* is lifted in the vertical direction. The path of travel of the first secondary weight 14*a* is guided via the bushings 42 that slide along secondary guide rods 72, independently of the head plate 16. Advantageously, the secondary weight selector mechanism 36 engages with the first secondary weight 14*a* so that the first secondary weight remains balanced (i.e. centered) in the horizontal direction H.

Figure 8:
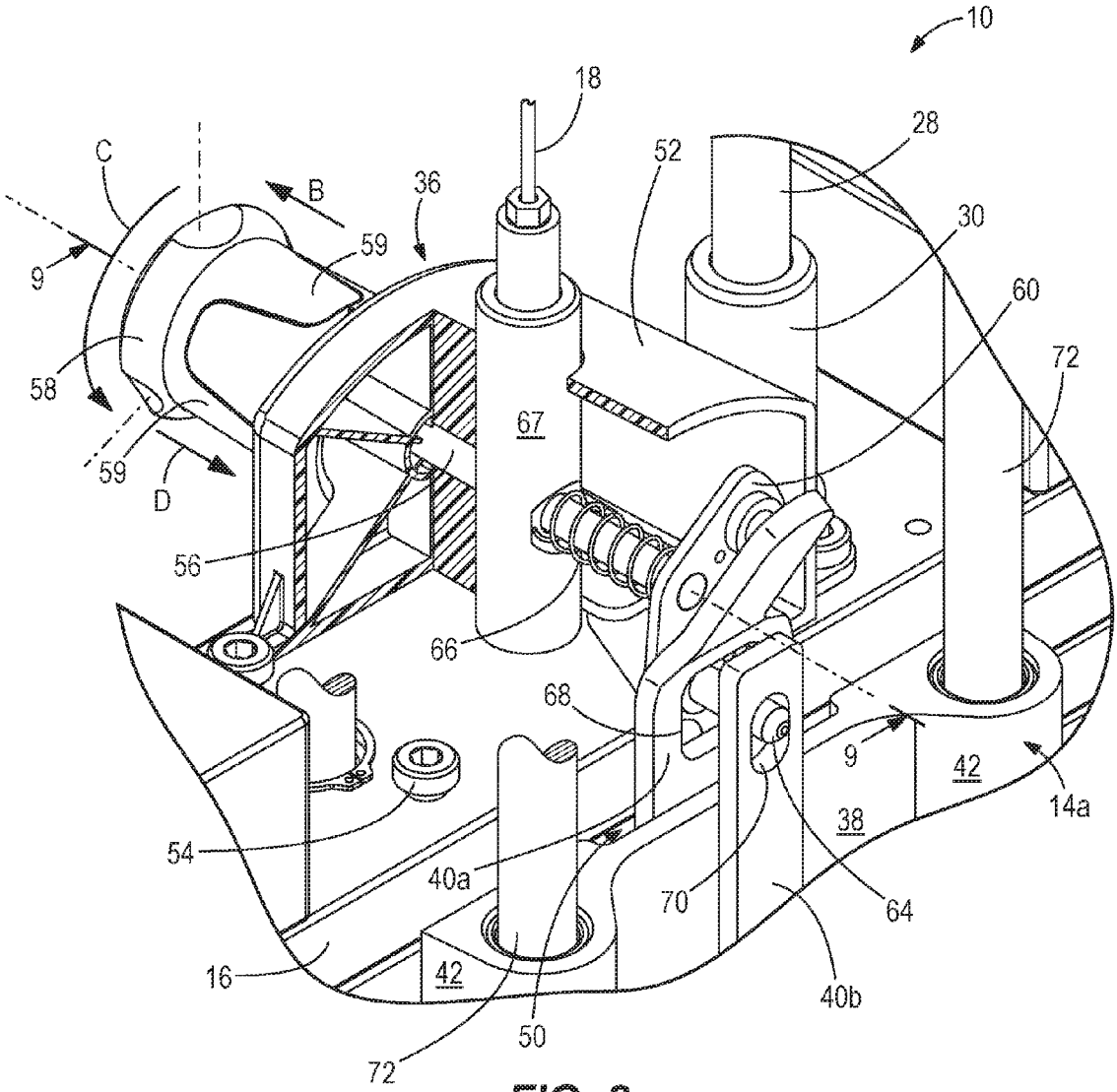
FIG. 8 is another view of the secondary weight selector mechanism, partially broken away.
Figure 9:
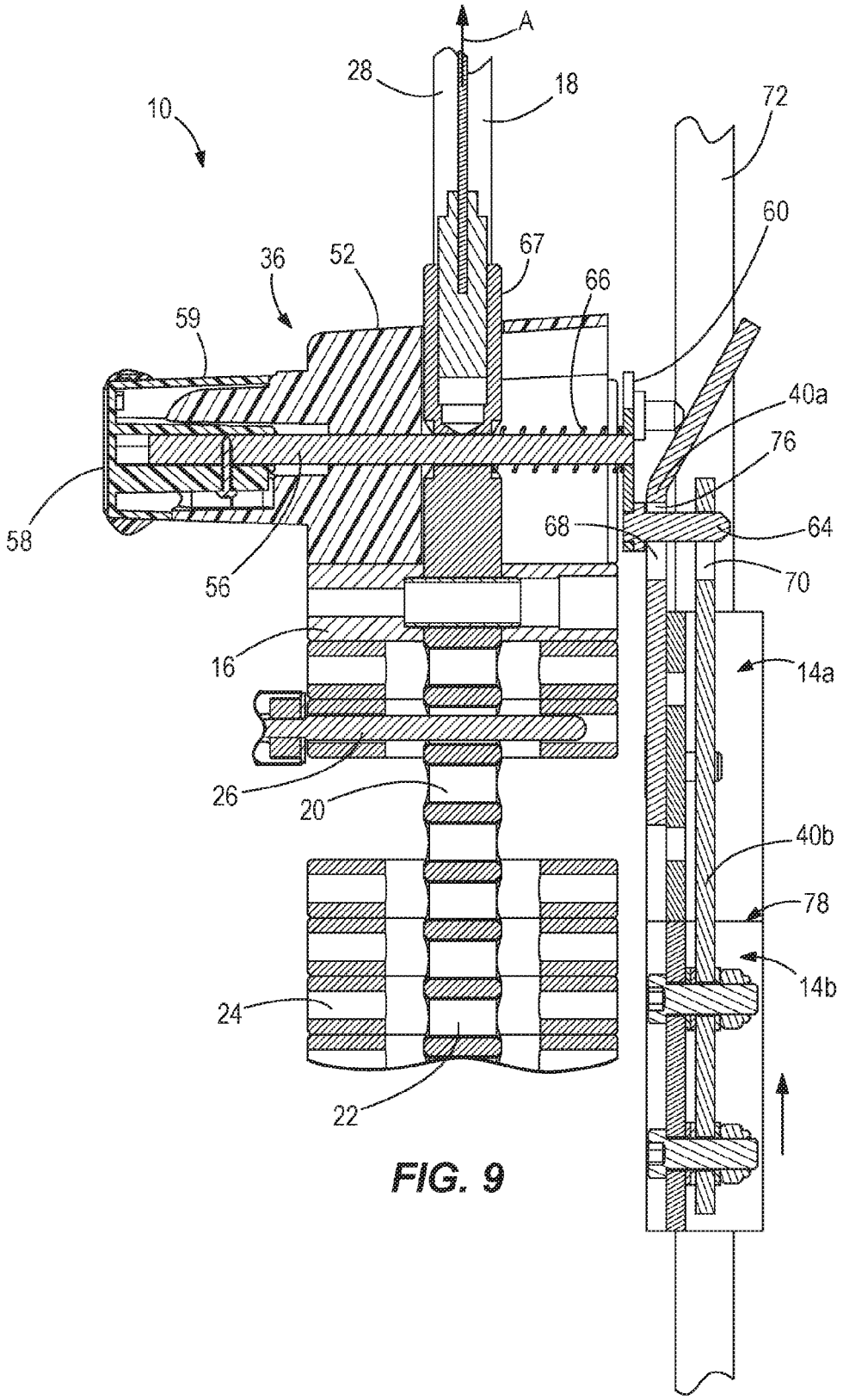
FIG. 9 is a view of section 9-9, taken in FIG. 8.

As shown in FIG. 8, if the user desires to add the second secondary weight 14*b*, with the user force receiving member 18 at rest, the user again manually pulls the handle 58 in the direction of arrow B, rotates the handle in the direction of arrow C, and releases the handle 58, thus allowing the bias of the spring 66 to move the handle 58 in the direction of arrow D so as to insert the second engagement pin 64 through the apertures 68, 70 via the through bore P. Thereafter, as shown in FIG. 9, applying a user force on the user force receiving member 18 lifts the bayonet 20, which lifts the primary weights 12, as discussed herein above, as well as both of the first and second secondary weights 14*a*, 14*b*, via engagement between the second engagement pin 64 and the pick-up bracket 40*b* of the second secondary weight 14*b*. Advantageously, when the force is applied to the user force receiving member 18, the secondary weight selector mechanism 36 is configured to engage with the second secondary weight 14*b* so that the first and second secondary weights 14*a*, 14*b* remain balanced (i.e. centered) in the horizontal direction H.

The present disclosure thus provides weight stack assemblies 10 for exercise apparatuses. The weight stack assembly 10 includes the plurality of primary weights 12 that are stacked in the vertical direction and the plurality of secondary weights 14 that are stacked in the vertical direction. Each of the secondary weights 14 weighs less than each of the primary weights 12. The head plate 16 is disposed on top of the plurality of primary weights 12 and carries the primary weight selector mechanism 17, which is configured to couple a user force receiving member 18 to one or more of the plurality of primary weights 12. The secondary weight selector mechanism 36 is also disposed on the head plate 16 and is configured to couple the head plate 16 to a first secondary weight 14*a* in the plurality of secondary weights 14 and to alternately couple the head plate 16 to a second secondary weight 14*b* and the plurality of secondary weights 14. The secondary weight selector mechanism 36 is uniquely configured to engage with the first secondary weight 14*a* and the second secondary weight 14*b* so that the first secondary weight 14*a* and second secondary weight 14*b* remain balanced in the horizontal direction H when a force is applied to the user force receiving member 18. The first secondary weight 14*a* is disposed on top of the second secondary weight 14*b* in the vertical direction V. Each comprises a body 38 and a pick-up bracket 40*a*, 40*b*, respectively, that vertically extends from the body 38. The secondary weight selector mechanism 36 includes the first and second engagement pins 62, 64 that extend in the lateral direction L, each being configured to engage with only one of the pick-up brackets 40*a*, 40*b* of the secondary weights 14*a*, 14*b*. Each pick-up bracket 40*a*, 40*b* includes a aperture 68, 70 that is configured to receive at least one of the first and second engagement pins 62, 64. The apertures 68, 70 are aligned in the lateral direction L so as to define the laterally extending through path P for the first and second engagement pins 62, 64. The first engagement pin 62 is shorter than the second engagement pin 64 in the lateral direction L. The first engagement pin 62 is configured to engage with the pick-up bracket 40*a* of the first secondary weight 14*a* and the second engagement pin 64 is configured to engage with the pick-up bracket 40*b* of the second secondary weight 14*b*. Thus, engagement of the first engagement pin 62 with the pick-up bracket 40*a* of the first secondary weight 14*a* couples the first secondary weight 14*a* and not the second secondary weight 14*b* to the head plate 16. Engagement of the second engagement pin 64 to the pick-up bracket 40*b* of the second secondary weight 14*b* couples both of the first and second secondary weights 14*a*, 14*b* to the head plate 16. The pick-up brackets 40*a*, 40*b* of the first and second secondary weights 14*a*, 14*b* are configured such that the second engagement pin 64 extends through and does not engage with the pick-up bracket 40*a* of the first secondary weight 14*a* when the second engagement pin 64 engages with the pick-up bracket 40*b* of the second secondary weight 14*b*.

The secondary weight selector mechanism 36 includes a rotary member that is configured to sequentially move the first and second engagement pins 62, 64 into positions (see FIGS. 7 and 9) in which the first and second engagement pins 62, 64 can engage with the pick-up brackets 40*a*, 40*b* of the first and second secondary weights 14*a*, 14*b*, respectively. The rotary member is biased towards the plurality of secondary weights 14*a*, 14*b* in the lateral direction L by a spring 66. The rotary member includes the axle 56 and end plate 60 and the first and second engagement pins 62, 64 extend from the end plate 60 in the lateral direction L. A handle 58 is on the axle 56 opposite of the end plate 60. The handle 58 is configured to be pulled by a user against the bias of the spring 66 to disengage the secondary weight selector mechanism 36 from the plurality of secondary weights 14*a*, 14*b*.

Each of the secondary weights 14*a*, 14*b* includes a set of bushings 42 that are spaced apart in the horizontal direction H and are configured to slide along secondary guide rods 44 in the vertical direction V independently of the head plate 16. The head plate 16 includes a pair of bushings 30 that slide along primary guide rods 28 that extend in the vertical direction V, independently of the secondary weights 14*a*, 14*b*.

In the present Description, certain terms have been used for brevity, clearness and understanding. No unnecessary limitations are to be implied therefrom beyond the requirement of the prior art because such terms are used for descriptive purposes only and are intended to be broadly construed. The different stair climber apparatuses, stair apparatuses, systems and methods described herein may be used alone or in combination with other apparatuses, systems and methods. Various equivalents, alternatives and modifications are possible within the scope of the appended claims.

What is claimed is:

1. A weight stack assembly for an exercise apparatus, the weight stack assembly comprising:

a plurality of primary weights that are stacked in a vertical direction, wherein each primary weight in the plurality of primary weights extends in the vertical direction, in a horizontal direction that is perpendicular to the vertical direction, and in a lateral direction that is perpendicular to the vertical direction and perpendicular to the horizontal direction;

a plurality of secondary weights that are stacked in the vertical direction and are located next to the plurality of primary weights in the lateral direction, wherein each secondary weight in the plurality of secondary weights extends in the vertical direction, horizontal direction, and lateral direction;

a head plate on top of the plurality of primary weights in the vertical direction;

a primary weight selector mechanism on the head plate, wherein the primary weight selector mechanism is configured to couple a user force receiving member to one or more of the plurality of primary weights;

a secondary weight selector mechanism on the head plate, wherein the secondary weight selector mechanism is configured to couple the head plate to a first secondary weight in the plurality of secondary weights and to couple the head plate to a second secondary weight in the plurality of secondary weights;

wherein the secondary weight selector mechanism is configured to engage with the first secondary weight so that the first secondary weight remains balanced in the horizontal direction when a force is applied to the user force receiving member, and wherein the secondary weight selector mechanism is further configured to engage with the second secondary weight so that the first and second secondary weights remain balanced in the horizontal direction when the force is applied to user force receiving member.

2. The weight stack assembly according to claim 1, wherein the plurality of primary weights are longer in the horizontal direction than the lateral direction and wherein the plurality of secondary weights are longer in the horizontal direction than the lateral direction.

3. The weight stack assembly according to claim 2, wherein the first secondary weight is vertically stacked on top of the second secondary weight.

4. The weight stack assembly according to claim 3, wherein each secondary weight in the plurality of secondary weights comprises a body and a pick-up bracket that vertically extends from the body.

5. The weight stack assembly according to claim 4, wherein the secondary weight selector mechanism comprises a plurality of engagement pins that extend in the lateral direction, each engagement pin in the plurality of engagement pins being configured to engage with only one of the pick-up brackets of the plurality of secondary weights.

6. The weight stack assembly according to claim 5, wherein each pick-up bracket comprises an aperture that is configured to receive at least one of the engagement pins in the plurality of engagement pins.

7. The weight stack assembly according to claim 6, wherein the apertures of the pick-up brackets are aligned in the lateral direction so as to define a lateral through-path for the plurality of engagement pins.

8. The weight stack assembly according to claim 7, wherein the plurality of engagement pins comprises a first engagement pin and a second engagement pin, wherein in the lateral direction the first engagement pin is shorter than the second engagement pin, and wherein the first engagement pin is configured to engage with the pick-up bracket of the first secondary weight and wherein the second engagement pin is configured to engage with the pick-up-bracket of the second secondary weight.

9. The weight stack assembly according to claim 8, wherein engagement of the first engagement pin with the pick-up bracket of the first secondary weight couples the first secondary weight and not the second secondary weight to the head plate and wherein engagement of the second engagement pin to the pick-up bracket of the second secondary weight couples both of the first and second secondary weights to the head plate.

10. The weight stack assembly according to claim 9, wherein the pick-up brackets of the first and second secondary weights are configured such that the second engagement pin extends through and does not engage with the pick-up bracket of the first secondary weight when the second engagement pin engages with the pick-up bracket of the second secondary weight and the force is applied to the user force receiving member.

11. The weight stack assembly according to claim 10, wherein the secondary weight selector mechanism comprises a rotary member that is configured to sequentially move the first and second engagement pins into a position in which the first and second engagement pins can engage with the pick-up brackets of the first and second secondary weights, respectively.

12. The weight stack assembly according to claim 11, wherein the rotary member is biased towards the plurality of secondary weights in the lateral direction.

13. The weight stack assembly according to claim 12, wherein the rotary member comprises an axle and a plate on the axle, wherein the first and second engagement pins extend from the end plate in the lateral direction.

14. The weight stack assembly according to claim 13, comprising a handle on the axle, opposite of the end plate, wherein the handle is configured to be pulled by a user against the bias to disengage the secondary weight selector mechanism from the plurality of secondary weights.

15. The weight stack assembly according to claim 1, wherein the first secondary weight is vertically stacked on top of the second secondary weight in the vertical direction, and wherein each weight in the plurality of secondary weights comprises a pair of bushings that are spaced apart in the horizontal direction and are configured to slide along guide rods in the vertical direction.

16. The weight stack assembly according to claim 15, wherein the set of bushings slide along the guide rods, independently of the head plate.

17. The weight stack assembly according to claim 15, wherein the first secondary weight comprises an inner surface and an opposite outer surface, wherein the inner surface of the first secondary weight faces the plurality of primary weights, wherein the second secondary weight comprises an inner surface and an opposite outer surface, wherein the inner surface of the second secondary weight faces the plurality of primary weights, wherein the pick-up bracket of the first secondary weight is attached to the inner surface of the first secondary weight, and wherein the pick-up bracket of the second secondary weight is attached to the outer surface of the second secondary weight.

18. The weight stack assembly according to claim 17, wherein the inner surface of the first secondary weight comprises a cavity in which the pick-up bracket is mounted.

19. The weight stack assembly according to claim 1, wherein the primary weight selector mechanism comprises a bayonet that extends vertically through the plurality of primary weights in the vertical direction and is configured to receive a selector pin extending in the horizontal direction for coupling one or more of the primary weights to the head plate.

20. The weight stack assembly according to claim 1, comprising a pair of bushings on the head plate, the bushings being configured to slide along guide rods that extend in the vertical direction, independently of the plurality of secondary weights.

* * * * *